US009324300B2

(12) United States Patent
Diez

(10) Patent No.: US 9,324,300 B2
(45) Date of Patent: Apr. 26, 2016

(54) EXTENDING BATTERY LIFE BY AUTOMATIC CONTROL OF DISPLAY ILLUMINATION

(76) Inventor: Mario Diez, San Diego, CA (US)

( * ) Notice: Subject to any disclaimer, the term of this patent is extended or adjusted under 35 U.S.C. 154(b) by 674 days.

(21) Appl. No.: 13/397,419

(22) Filed: Feb. 15, 2012

(65) Prior Publication Data

US 2013/0208031 A1 Aug. 15, 2013

(51) Int. Cl.

| | |
|---|---|
| ***G09G 5/02*** | (2006.01) |
| ***G09G 5/14*** | (2006.01) |
| *G09G 3/34* | (2006.01) |

(52) U.S. Cl.

CPC ..... *G09G 5/14* (2013.01); *G09G 3/3426* (2013.01); *G09G 2320/0686* (2013.01); *G09G 2330/023* (2013.01)

(58) Field of Classification Search

CPC ..... G09G 2330/023; G09G 2320/0686; G09G 3/3426; G09G 5/14

USPC ..... 345/33, 34, 36, 204, 211, 694, 698

See application file for complete search history.

(56) References Cited

U.S. PATENT DOCUMENTS

| | | | | |
|---|---|---|---|---|
| 5,745,186 | A * | 4/1998 | Shimizu et al. | 348/562 |
| 5,883,605 | A | 3/1999 | Knapp | |
| 6,791,566 | B1 | 9/2004 | Kuratomi et al. | |
| 7,176,943 | B2 * | 2/2007 | Meyers | G06F 3/0481 345/1.1 |
| 7,643,095 | B2 | 1/2010 | Yoshii | |
| 8,358,273 | B2 | 1/2013 | Hodge et al. | |
| 8,698,859 | B2 * | 4/2014 | DeLuca | 345/698 |
| 8,730,180 | B2 * | 5/2014 | Kim | 345/173 |
| 8,780,029 | B2 * | 7/2014 | Nakamura et al. | 345/89 |

FOREIGN PATENT DOCUMENTS

| | | |
|---|---|---|
| EP | 1696414 | 8/2006 |

* cited by examiner

*Primary Examiner* — Abbas Abdulselam

(74) *Attorney, Agent, or Firm* — Fish & Tsang, LLP

(57) ABSTRACT

A display screen of a computer is segmented into several portions, some of which are marked "used" and others which are marked "unused." When the system is activated on the computer, the computer will decrease the luminance of unused portions of the display screen to save electricity.

9 Claims, 4 Drawing Sheets

EXTENDING BATTERY LIFE BY AUTOMATIC CONTROL OF DISPLAY ILLUMINATION

FIELD OF THE INVENTION

The field of the invention is monitor control devices.

BACKGROUND

New innovations in computer technology have allowed portable computers, such as laptops, tablets, media players, and cellular phones, to perform more tasks using less power. While new metals and transistors with lower resistivity have helped reduce power requirements significantly, the power requirements for bright electronic screens drain quite a bit of portable computer battery life. As used herein, a "portable computer" is any computer that is coupled to a rechargeable battery power source, preferably a power source that is located within a body housing of the computer.

Many computer screens have easily accessible brightness controls in order to decrease the screen's luminescence along the sides of the portable computer device or on an attached keyboard through use of a function key. This is especially useful when a user brings a portable computer into a dimly lit room when a brightly lit backlit screen is not necessary. Such portable computer screens, however, require a mindful human user to manually dim and brighten the screen according to need.

EP1696414 to Lowles teaches a light sensor coupled to the display of a portable computer, where the display automatically dims or brightens depending upon ambient light conditions. Using a light sensor to automatically control the brightness of a screen, however, can oftentimes increase the power drain on the portable computer system since powering and processing light sensor circuitry adds its own power drain. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

U.S. Pat. No. 6,791,566 to Kuratomi teaches a display device that could be coupled to a portable computer, where the image display has a non-uniform luminance across the screen, such that the center of the screen is brighter than the edges of the screen. By providing such a gradiated luminance, Kuratomi's display device reduces power consumption while focusing a user's attention towards the center of the display screen. Kuratomi's device may be useful when viewing an electronic microscope or camera, where a user is primarily focused on the center of the screen, but is far less useful when a user wishes to focus on other parts of the screen that are not centered.

U.S. Pat. No. 7,643,095 to Yoshii increases the luminance of a screen when the screen displays movies and television shows that require such increased luminance, but decreases the luminance of the screen when the screen displays text documents that do not require increased luminance. Yoshii's system is useful for systems that switch from a television input to a computer input, but is far less useful when used with portable computer systems that show both video media and text media on the same screen.

Thus, there is still a need for improved screen-dimming technologies that decrease power requirements of a screen.

SUMMARY OF THE INVENTION

It has yet to be appreciated that a system could be designed where only the primary used portions of a display screen are illuminated at a higher luminance than the secondary, unused portions of the display screen in order to conserve power.

The inventive subject matter provides apparatus, systems and methods in which a display screen is segmented into used and unused portions, where the system automatically decreases the luminance of the unused portion of the display screen. A display screen could be segmented into "used" and "unused" portions in a variety of ways. For example, when using an operating system like Windows® or OS X®, where a plurality of windows could be simultaneously opened on a computer screen, the system could segment the active window as the used portion of the display screen and all other portions of the screen as unused portions of the display screen. Alternatively, an active window could be further segmented into smaller frames, some of which are active and some of which are passive, and the system could then deem an active frame as a used portion while the rest of the screen is deemed unused. A display screen could also have a plurality of used portions that are unconnected to one another, for example a taskbar along the bottom of the screen and a window in the middle of the screen could be deemed used portions while the rest of the screen is deemed unused. Preferably, every section or pixel of a display screen is deemed used or unused.

As used herein, an "active" portion of a user interface is a portion of the display screen that is controlled by a foreground process of the computer system. In an exemplary embodiment, when using an operating system like Windows® or OS X®, a plurality of windows on the computer screen indicates a plurality of processes running simultaneously. Such windows could be layered one on top of another, or could be tiled as in the case of HTML frames. For the purposes of this application, when a plurality of windows exist on a display screen, the selected or "active" window on the display screen would be considered the used portion of the display screen, while the portions of the display screen that are not utilized by the active window would be considered unused. When the system segments the display screen into used and unused portions, the size of the used portion could be slightly larger than the active portion of the user interface, or larger than the user interface itself. In alternative embodiments, the size of the used portion could be at least 5, 10, 20, 40, or 50 $cm^2$ larger than the size of the user interface.

As used herein, a "foreground process" is an invoked program having an active user interface displayed on a display screen in such a way as to allow a user to interact with the active user interface. For example, a word processor invoked as a foreground process will allow a user to type words into a document, a video invoked as a foreground process will allow a user to play, pause, and fast-forward a video, and a file manager invoked as a foreground process will allow a user to manipulate files within a directory structure. Invoked programs that a user could interact with that does not have an active user interface displayed on a display screen are considered background processes.

While the active portion of a user interface of a program invoked as a foreground process could consist of the entire used portion of the display screen, the used portion of the display screen could consist of more than just the active portion of the user interface, and could be larger than the user interface itself. Exemplary user interfaces include a window of a video, a touch-sensitive button on a touch-sensitive display screen, a document displaying text, a drawing, or some other visual representation that the user could interact with using a touch screen, mouse, joystick, keyboard, touch pad, or some other input of a user interface coupled to the computer system.

In order to conserve power running through a computer screen, the system generally first detects which program is invoked as a foreground process, partitions the screen into a used portion and an unused portion, where the used portion contains a portion of the program's user interface, and then decreases the luminance of the unused portion of the display screen. In some embodiments, when a user switches between one program to another, the program could re-segment the screen as the foreground process program changes. As used herein, "luminance" means the intensity of light or color emitted from a portion of the display screen. Where a display screen does not emit light, such as a display screen using e-ink, "luminance" refers to the intensity of the color displayed in that section of the screen. Generally, portions of a display screen that have a higher intensity of light or color require a greater amount of power, while portions of a display screen that have a lower intensity of light or color require a lower amount of power. Thus, by decreasing a luminance of a portion of the screen, the system decreases the overall power usage of the computer.

Generally, when the system decreases the luminance of the unused portion of the display screen, the system keeps the luminance of the active, used portion of the display screen constant. However, in contemplated embodiments, the system could be configured to decrease the luminance of the used portion by a first amount and decrease the luminance of the unused portion by a second amount greater than the first decreased amount. The luminance of the used or unused portion could be decreased by any amount, for example, the luminance of the unused portion could be decreased by 10, 50, 100, 200, 300, 400, or even by 500 cd/m$^2$ (candela per square meter) or by a percentage, such as by 50%, 70%, 80%, 90%, or by 95%. Preferably, the unused portion is decreased to an amount below 200, 100, or even 50 cd/m$^2$ in order to conserve a large amount of power. While the pixels of the unused portion could be shut off completely, preferably the unused portion is set to have a luminance above a minimum threshold, such as at least 200, 100, or even 50 cd/m$^2$, or by at least 20%, 10%, 5% or 1%, so that a user could see other unused portions of the screen. In alternative embodiments, the luminance of the unused portion could be decreased the further a pixel is from the used portion. For example, the luminance of a pixel of an unused portion could be decreased as a function of a distance from the perimeter of the used portion of the screen.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Various objects, features, aspects and advantages of the inventive subject matter will become more apparent from the following detailed description of preferred embodiments, along with the accompanying drawing figures in which like numerals represent like components.

DETAILED DESCRIPTION

It should be noted that while the following description is drawn to a computer/server based work package processing system, various alternative configurations are also deemed suitable and may employ various computing devices including servers, interfaces, systems, databases, engines, controllers, or other types of computing devices operating individually or collectively. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclose apparatus. In especially preferred embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network.

One should appreciate that the disclosed techniques provide many advantageous technical effects including reducing power consumption of devices having display screens.

Figure 1:
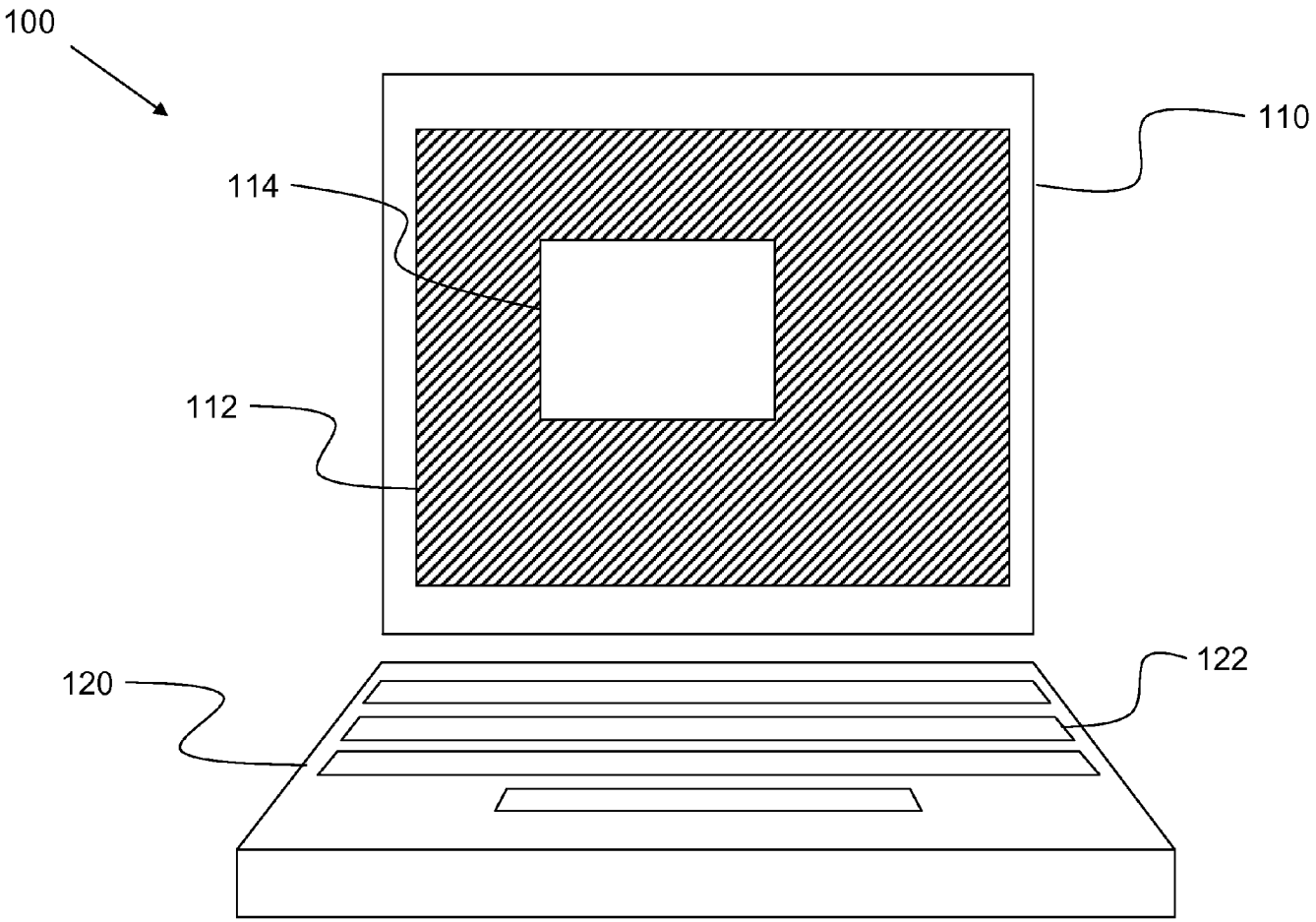
FIG. 1 is a front, perspective view of a computer laptop having a user interface partitioned into a used portion and an unused portion.

In FIG. 1, a portable computer 100 generally has a display screen 110 and a computer body 120 having a processor (not shown) memory (not shown) and a user interface input 122, usually in the form of a keyboard and/or touchpad. When the system is installed and activated on the portable computer 100, the system will generally partition the display screen 110 into a used portion 114 and an unused portion 112, and will reduce a luminance of the unused portion by an amount. The luminance of the unused portion is preferably decreased to below 100 cd/m$^2$, and the pixels of the unused portion could be turned off completely. As used herein, a "portable computer" is any computer that is coupled to a battery and does not need to be coupled to a wall outlet in order to consume power.

Figure 2B:
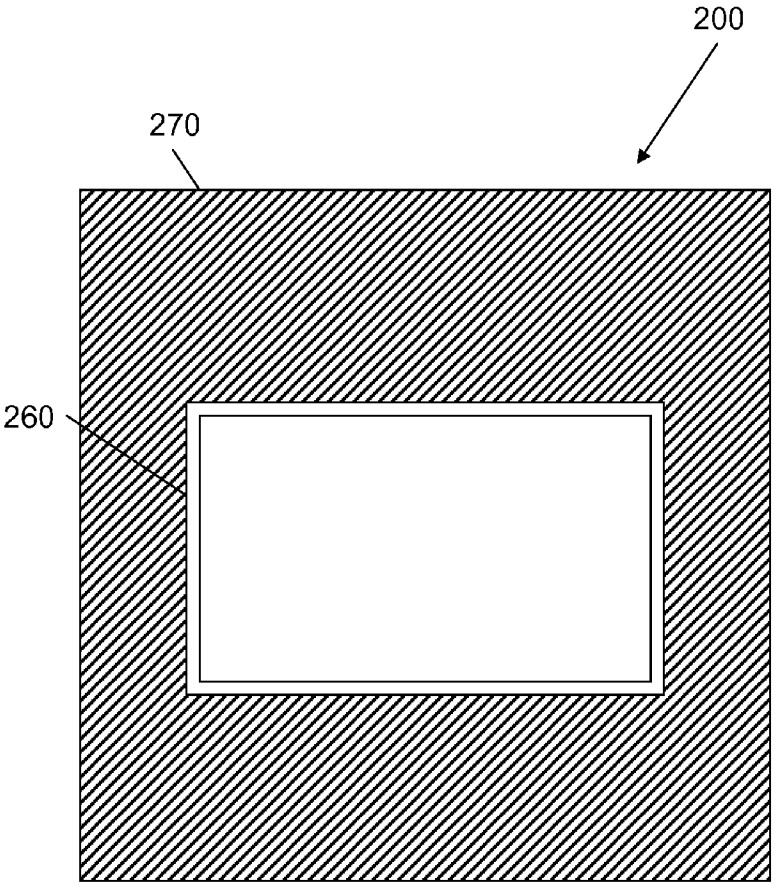
FIG. 2B is the exemplary display screen of FIG. 2A having been partitioned into a single used and unused portion in accordance with one embodiment.
Figure 2A:
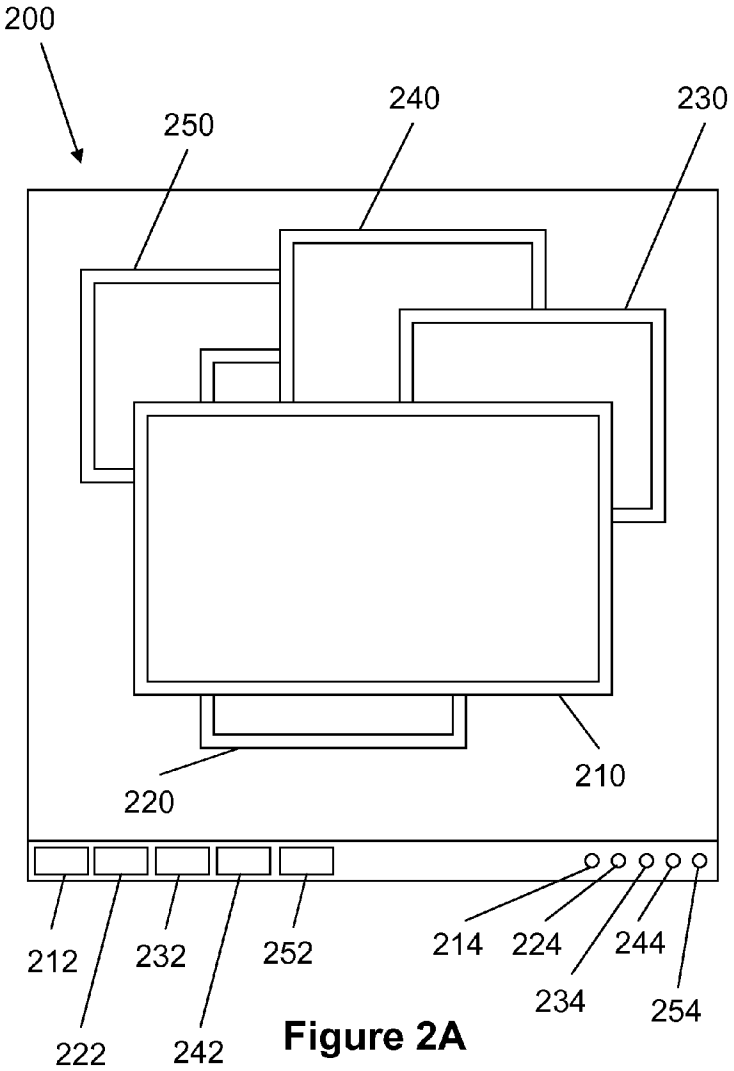
FIG. 2A is an exemplary display screen having a plurality of user interfaces invoked.

In FIG. 2A, an exemplary display screen 200 has a plurality of user interface windows 210, 220, 230, 240, and 250 invoked by various programs running on the system. Each program has a plurality of user interface windows. For example, a first program (not shown) has a user interface window 210, a program taskbar button 212, and a program taskbar icon 214, a second program (not shown) has a user interface window 220, a program taskbar button 222, and a program taskbar icon 224, a third program (not shown) has a user interface window 230, a program taskbar button 232, and a program taskbar icon 234, a fourth program (not shown) has a user interface window 240, a program taskbar button 242, and a program taskbar icon 244, and a fifth program (not shown) has a user interface window 250, a program taskbar button 252, and a program taskbar icon 254. As shown, the first program is invoked as the foreground process, since user interface window 210 is shown as the most prominent user interface window covering the other user interface windows on the display screen.

In FIG. 2B, an exemplary system has been invoked that has partitioned the display screen 200 from FIG. 2A into a used portion 260 and an unused portion 270. As shown, the system has deemed the used portion 260 to be the entire window 210 of the foreground process, although the system could deem the used portion 260 to be a smaller portion of the window 210 or a larger portion of window 210 without departing from the scope of the invention. Generally the luminance of the unused portion 270 will be decreased to decrease power consumption by display screen 200, for example by reducing the intensity of power to the unused portion 270 by a threshold amount, or by directly controlling an intensity of light or color emitted by individual pixels of the unused portion 270. In some embodiments, the unused portion 270 could be completely shut off, while in other embodiments the luminance of the unused portion 270 might be kept just above a minimum threshold, while in still other embodiments the luminance of sections of the unused portion might decrease gradually as the user's eyes move towards the edges of display screen 200.

Figure 2D:
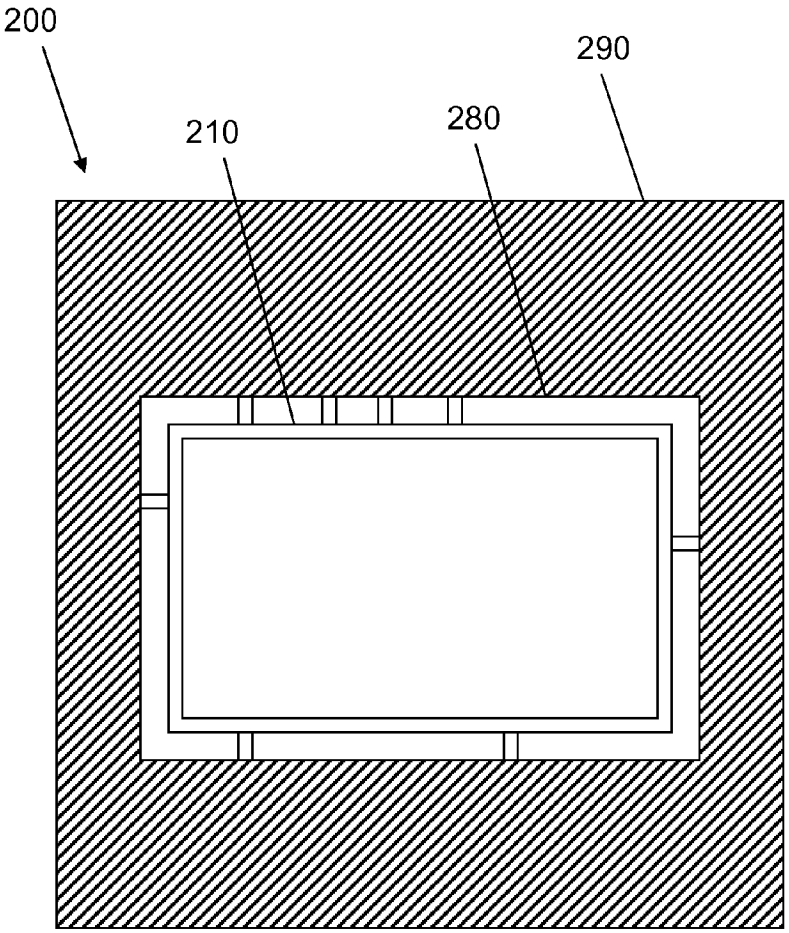
FIG. 2D is the exemplary display screen of FIG. 2A, having been partitioned into a plurality of used portions in accordance with another embodiment.
Figure 2C:
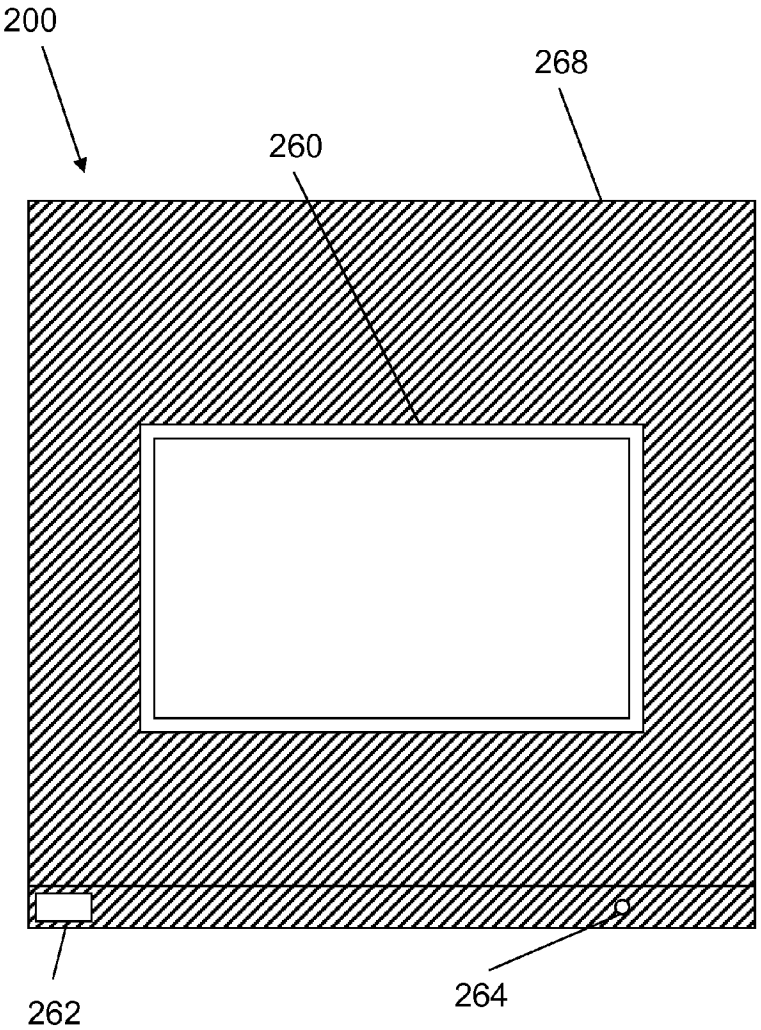
FIG. 2C is the exemplary display screen of FIG. 2A having been partitioned into a different used and unused portion in accordance with an exemplary embodiment.

In FIG. 2C, an exemplary system partitions the display 200 into several used portions 260, 262, and 264, and an unused section 268. Used portion 260 represents a first user interface of the program displayed euphemistically as a window of an operating system, used portion 262 represents a second user interface of the program displayed euphemistically as a program taskbar button, and used section 264 represents a third user interface of the program displayed euphemistically as a program taskbar icon. Thus, a display 200 could have a plurality of user interfaces, one or more of which are designated as "used" sections, while the rest of the screen is designated as "unused."

In FIG. 2D, an exemplary system partitioned the display 200 into a used section 280 and an unused section 290, where the used section 280 is slightly larger than user interface window 210, and shows portions of other user interfaces that are not part of the foreground process. However, since a large part of display 200 is still designated as unused, much of the power consumed by display screen 200 is reduced by this embodiment.

Figure 3:
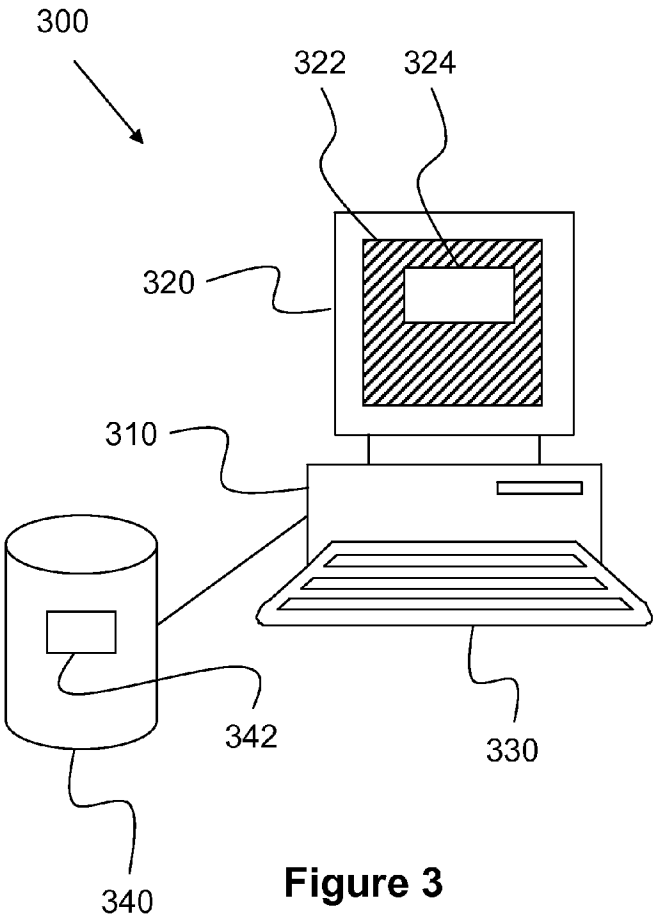
FIG. 3 is a front, perspective view of a desktop computer having a user interface partitioned into a used portion and an unused portion.

In FIG. 3, a second exemplary software program 342 is installed on a memory 340 of a computer system 310 having monitor 320, used portion 324, unused portion 322. Memory 340 could be a hard drive, floppy disk, networked attached memory, or could be a memory coupled to computer system 310 through a non-standard or standard interface driver, such as a USB or firewire driver. Preferably, memory 340 is always accessible by computer system 310. Once a user invokes program 342, a processor (not shown) in computer system 310 analyzes the programs and user interfaces sent to monitor 320 and partitions monitor into a used portion 324 and an unused portion 322. Generally, used portion 324 is a foreground process that a user can interact with using user interface input 330, shown euphemistically as a keyboard input to computer system 310.

Figure 4:
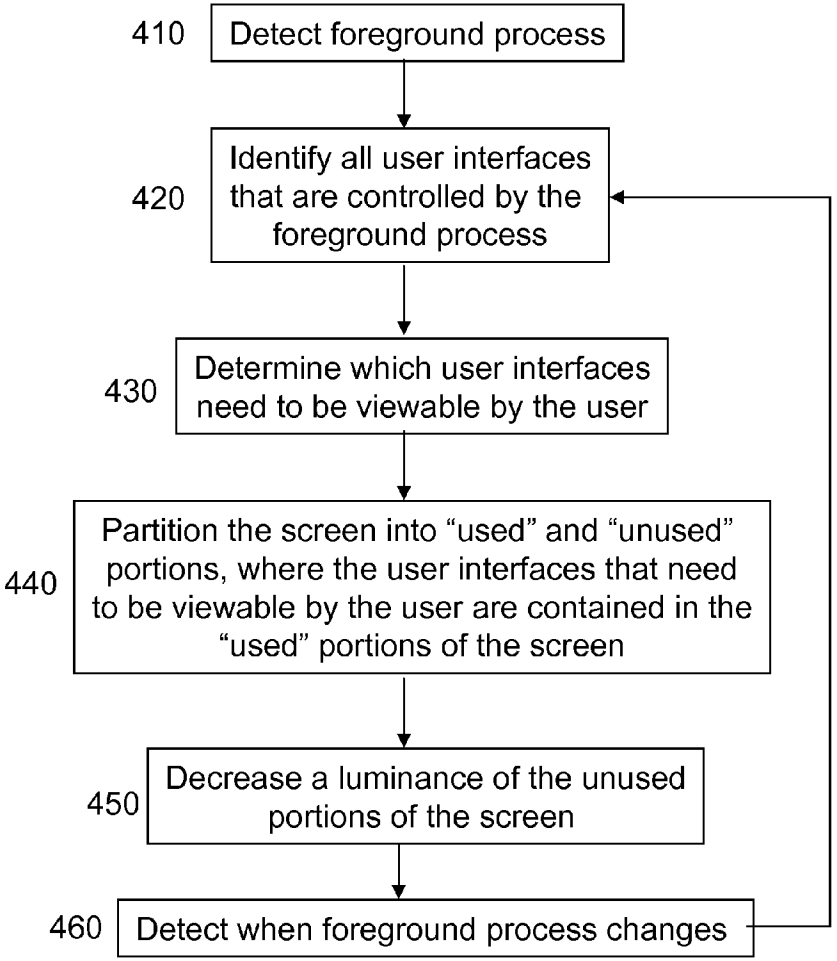
FIG. 4 is an exemplary flowchart of actions taken by an embodiment of a software program in accordance with an aspect of the invention.

In FIG. 4, an exemplary method is shown. In step 410, the software program detects the foreground process invoked by the computer system. Once the foreground process is identified, in step 420, the program identifies all user interfaces that are controlled by the foreground process and then determines which user interfaces 430 need to be viewable by the user (i.e. designated as "used"). Preferably, a user could customize in advance the types of user interfaces that should be viewable by the user, such as only the windows or both the windows and taskbar icons, or all user interfaces viewable on the screen. Once the program determines which user interfaces should be viewable by the user, the program then partitions the screen into used and unused portions in step 440. Preferably, the used portions correspond directly to the area of the screen that is used by the foreground process, however, a user can preferably customize the program to display slightly more or slightly less than the areas utilized by user interface without departing from the scope of the invention. Lastly, in step 450, the program decreases a luminance of the unused portion(s) of the screen.

In some embodiments, this process could be triggered by a command entered by the user, such as a hot-key, however the process could be automatically triggered without departing from the scope of the invention. For example, such a process could be automatically triggered as part of a screensaver that detects an absence of input from the user. The program could assume that the user is watching a movie, and therefore does not want the entire screen to be deluminated, but would prefer it is the unused portion of the screen were to be deluminated. In other embodiments, the program could be invoked all the time and when a user changes foreground processes in step 460, the program could automatically re-shift the used and unused portions of the screen accordingly. In this manner, a user could cycle through a plurality of programs on his/her computer, and each time the user switches a the foreground process or the foreground user interface, the luminance of the screen could be altered to follow the movement between foreground processes on the computer system.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of conserving power used to operate a display, comprising:

detecting operation of a foreground process program;

operationally partitioning the display into (a) a used portion configured to accommodate at least part of a user interface for the foreground process program, and (b) an unused portion, which is not used for the at least part of the user interface;

dimming luminance of the unused portion of the display screen relative to luminance of a the used portion of the display screen; and re-partitioning the display to provide different used and unused portions as the foreground process program changes to a different process program.

2. The method of claim 1, wherein a size of the used portion is smaller than a size of a usable area of the display.

3. The method of claim 1, further comprising dimming the unused portion comprises decreasing the luminance of the unused portion below 100 $cd/m^2$.

4. The method of claim 1, further comprising dimming pixels of the unused portion to at least first and second different levels of dimming as a function of a distance from the used portion.

5. The method of claim 1, wherein the user interface comprises a plurality of user interface windows.

6. The method of claim 1, further comprising beginning dimming of the unused portion at a non-zero distance from an edge of the used portion.

7. The method of claim 1, wherein a size of the used portion is at least 10 $cm^2$ larger than a size of the unused portion.

8. The method of claim 1, wherein the luminance of the unused portion decreases gradually as a function of a distance from a perimeter of the window-delimited portion.

9. The method of claim 1, wherein control over the luminance of the unused portion can be triggered by a command entered by a user action.

* * * * *